United States Patent [19]

Miura

[11] Patent Number: 4,532,742

[45] Date of Patent: Aug. 6, 1985

[54] EXTENDIBLE STRUCTURE

[75] Inventor: Koryo Miura, 9-7, Tsurukawa 3-chome, Machida-shi, Tokyo, Japan

[73] Assignees: Mitsubishi Denki Kabushiki Kaisha; Koryo Miura, both of Tokyo, Japan

[21] Appl. No.: 539,949

[22] Filed: Oct. 7, 1983

[30] Foreign Application Priority Data

Oct. 9, 1982 [JP] Japan ..... 57-178196
Mar. 2, 1983 [JP] Japan ..... 58-34168

[51] Int. Cl.[3] ..... E04H 12/18
[52] U.S. Cl. ..... 52/108; 52/646
[58] Field of Search ..... 52/108, 109, 110, 111, 52/121, 122, 123, 638, 646, 645, 116, 117; 244/173, 157; 182/152, 40, 41; 901/14

[56] References Cited

U.S. PATENT DOCUMENTS 3,486,279 12/1969 Webb ..... 52/108
3,611,652 10/1971 Rabenhorst ..... 52/110
4,334,391 6/1982 Hedgepeth ..... 52/108

*Primary Examiner*—John E. Murtagh
*Assistant Examiner*—Kathryn L. Ford
*Attorney, Agent, or Firm*—Oblon, Fisher, Spivak, McClelland & Maier

[57] ABSTRACT

An extendible structure of the invention is constructed by connecting the radially projecting legs of the spacer with differing longerons through the joints, and then fastening one joint with adjacent another joint at a diagonally opposed position with a bridle. In the extended state of the structure, the spacers are within a plane which is substantially perpendicular to the direction of extension of the structure and the bridles are extended in the diagonal lines between the adjacent joints to thereby form the longerons in a mast-shaped three-dimensional structure, while, in the collapsed state of the structure, the longerons are collapsed in a loop form and the spacers are laid one upon another inside the loop formed by the longerons to thereby produce a cylindrical form in its outer appearance.

9 Claims, 17 Drawing Figures

FIGURE 1
PRIOR ART
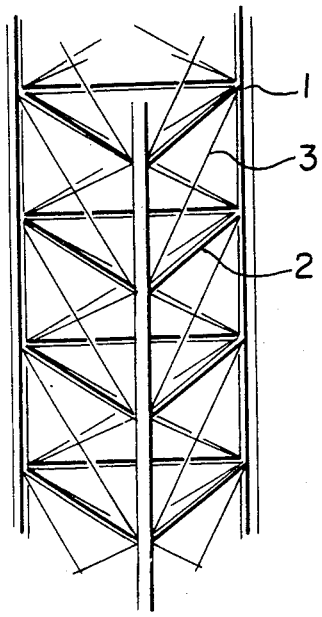
FIGURE 2
PRIOR ART
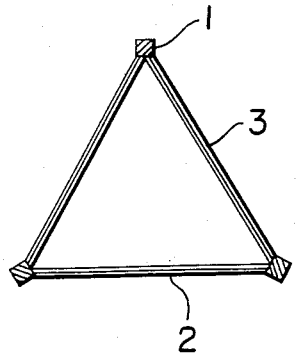
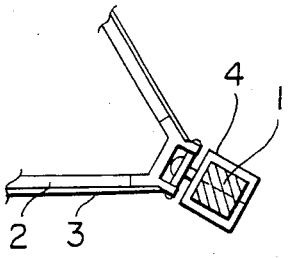
FIGURE 3
PRIOR ART FIGURE 4
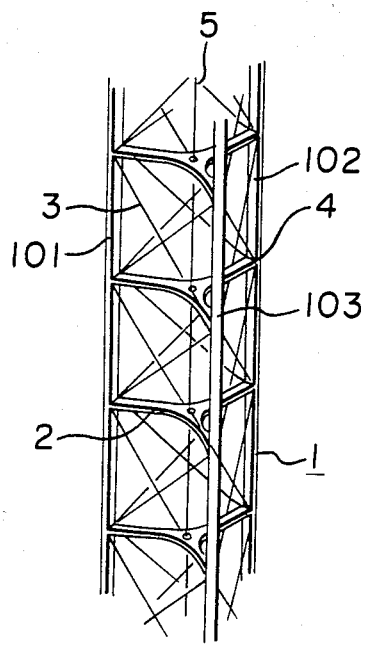
FIGURE 5
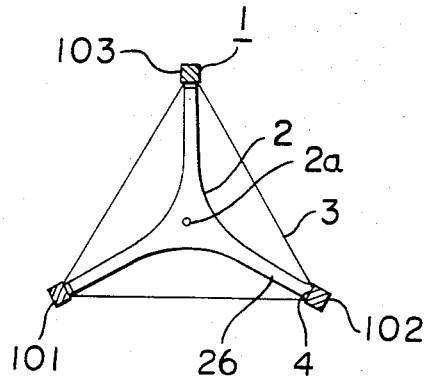
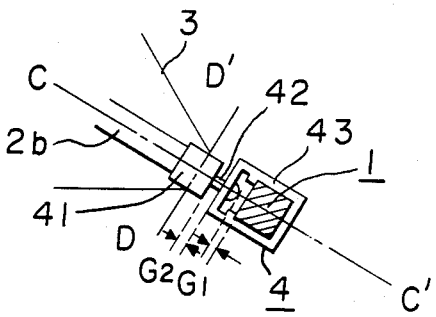
FIGURE 6

EXTENDIBLE STRUCTURE

This invention relates to an extendible structure, and, more particularly, it is concerned with such an extendible structure that can be confined in a small space when it is collapsed, and deployed into a longitudinal truss when it is extended. More concretely, the invention has reference to an extendible structure which is used for an extendible mechanism for a paddle of a solar battery for use in some outer space applications.

Many of the present and future structural objects to be used in the outer space applications are generally required to have larger dimensions. However, such structural members should be carried into the outer space aboard rockets, space shuttles, and other modules, they are subjected to restriction by the dimension in the cargo bay of such carrying vehicles. Such restriction to the structural members has been the technical problem to be solved on this type of the extendible structure.

As a prior art paying attention to this technical problem, there has been known, for example, U.S. Pat. No. 3,486,279, the outline of which is as shown in FIGS. 1 and 3 of the drawing of this application, wherein the deployable lattice column is constructed with three longerons (1), a plurality of triangular spacers (2) made up of thin square bars and joined at the horizontal positions with the longerons (1) through joints (4), and numerous lanyards extended diagonally to connect the joints (4) at diagonally opposed positions.

In this construction, the principle of collapse and extension of the structure is based on the properties of the structural material such that, when a compressive force is applied to the structure extended in a mastshape in the direction of its center axis, it is wound into a coil-form, and, when the compressive force is released, it extends rectilinearly to return to the mast-shape. While this type of structure is a constructed object, it is also a kind of mechanism. Number of the component parts are innumerable even at the last, hence number of the joints for combining these component parts amount to be considerable. This would increased, needless to say, the number of inspections to be performed in the functional tests of the structure, which suggests, in the case of its utilization in the outer space application, in particular, demanding extremely high reliability in operation, considerable time to be spent for the inspections and exorbitant cost to be accompanied therewith. As a matter of fact, the cost for the inspection surpasses too far the cost for its manufacture.

On the part of the manufacturer, since the mast-shaped structure capable of functioning properly is first obtained by delicate and minute adjustments in length of the component parts so that the tensile force and the compressive force among them may be in adequately balanced conditions, there would incur considerable time and labor in the adjustments of such numerous component parts, as the consequence of which there has been desire for improvements in the aspects of the reliability and the manufacturing cost of such structural product.

Based on the afore-described principle of extension and collapse of the structure, the relative positions of both ends of the mast-shaped structure is such that, at the time of collapse and extension, they are rotationally displaced around the center axis of the mast-shaped structure. In short, they assume the positions after their rotations for several times to several tens of times. This property of the structure poses various difficult problems in designing the systems for the outer space structures.

For example, in simple case of projecting an independent body such as sensors, photographic cameras, etc. from the satellite main body, there is the least problem. However, when such independent body is to be incorporated in a somewhat complicated system, the problem arises promptly. The reason for this is that the object mounted on the distal end part of the mast-shaped structure rotates itself, and the next part connected with the rotating object should also move in conformity to the rotation of the object, such rotation affecting sequentially and consecutively the subsequent parts of the structure, hence the system as a whole would be influenced. Such situation would occur even in the system where the paddle of the solar battery is simply extended. Usual measures against this rotational force is to provide a rotational sliding part (for instance, a canister device) at one end of the structure. This preventive measures, however, brings about decrease in rigidity at that end part, renders the mechanism of the structure to be complicated, requires slip-rings for its electrical system, and various other disadvantages. Therefore, the conventional structure of this type is still beyond reach of its full practical use in spite of the remarkable feature such that it is extremely light in weight and can be collapsed in a compact size.

It is a primary object of the present invention to provide an extendible structure which is light in weight and made up of as less numbers of component parts as possible, more concretely, an extendible structure with the number of the horizontal members to be joined with the longerons being decreased by a few fractions, with less number of joints to connect the component parts, and yet with simplified form of the joints.

It is another of the present invention to provide an extendible structure which accompnies reduced cost and labor for its assembly, insepction, and adjustment of the component parts.

It is still another object of the present invention to provide an extendible structure which is highly reliable and the least in its structural redundancy.

It is other object of the present invention to provide an extendible structure which, in the designing of the spacers, is subjected to less restriction and has high degree of freedom in relation to the longerons.

It is still other object of the present invention to provide an extendible structure, in which the spacers are of the Rahmen structure bearing its bending moment within its plane at the center part thereof.

According to the present invention, in general aspect of it, there is provided an extendible structure comprising in combination: three or more numbers of extendible longerons; a plurality of joints provided on each of the longerons at predetermined space intervals among them; a plurality of integrated radial spacers, each having a plurality of legs integrally formed with the spacer and radially extending from the center part thereof, each leg being rotatably connected with the joint provided at differing position on each of the longerons; and a plurality of bridles for connecting one of the joints with adjacent another joint at a diagonally opposed position, wherein, in the extended state of the structure, the three or more longerons are deployed in parallel one another with space intervals among them in the lateral dirction which intersects with the direction of extension of said longerons, said spacers support the longerons with the horizontally spaced intervals within a plane substantially perpendicular to the direction of extension of the longerons, and the bridles are extended to impart the tensile force between the joints which are at the diagonally opposed positions, and further, in the collapsed state of the structure, each of the longerons are collapsed in a loop form and the spacers are laid one upon another inside the loop formed by the longerons.

The foregoing objects, other objects as well as the specific construction and operations of the extendible structure according to the present invention will become more apparent and understandable from the following detailed description of a few preferred embodiments thereof, when read in conjunction with the accompanying drawing.

In the drawing:

FIG. 1 is a perspective view, in part, of a conventional extendible structure of this type in its developed or extended state;

FIG. 2 is a horizontal cross-section of the conventional extendible structure shown in FIG. 1;

FIG. 3 is an enlarged cross-sectional view, in part, showing a connection between the longeron and the spacer in the conventional extendible structure shown in FIG. 1;

FIG. 4 is a perspective view, in part, of one preferred embodiment of the extendible structure according to the present invention in its developed or extended state;

FIG. 5 is a horizontal cross-sectional view of the embodiment shown in FIG. 4; FIG. 6 is an enlarged cross-sectional view, in part, showing a connection between the longeron and the spacer in the preferred embodiment of the present invention as shown in FIG. 4;

Figure 8:
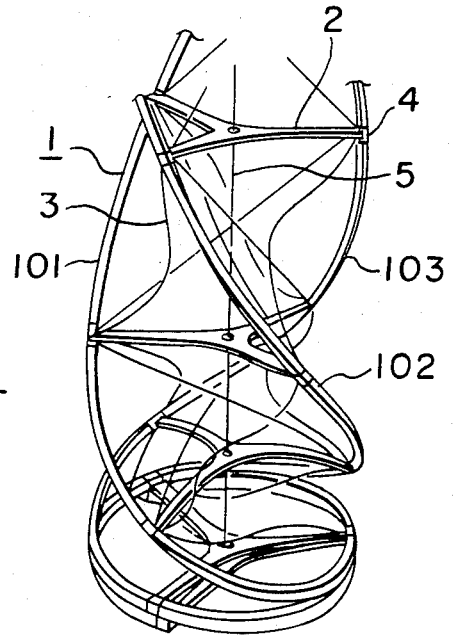
FIG. 8 is also a perspective view of the preferred embodiment shown in FIG. 4 showing a state, wherein it is being extended from the collapsed state.

In the following, the present invention will be described in specific details in reference to the accompanying drawing.

Referring to FIG. 4, three longerons 1 made of flexible material such as FRP (fiber reinforced plastics), etc. stand upright in parallel with a predetermined space interval being provided among them in the lateral direction, and a plurality of spacers 2 are horizontally provided at predetermined space intervals among them and along the lengthwise direction of the longerons 1 to interconnect the same. Each of the spacers 2, in addition, are positioned within a plane which is substantially perpendicular to the longitudinal direction of the longerons 1. The spacer 2 has a through-hole 2*a* formed at the center part thereof and a plurality of legs 26 formed integrally with and projecting radially from the center part in number corresponding to the number of the longerons 1, these legs 26 being connected with the individual longerons 1 through the joints 4, as shown clearly in FIGS. 5 and 6. A bridle 3 is extended diagonally between one joint 4 and adjacent another which is at a diagonally opposite position so as to increase rigidity of the structure as a whole after it has been stretched out. Further, a lanyard 5 such as a wire, etc. passes rectilinearly through the holes 2*a* in the spacers 2 along the longitudinal direction of the longerons 1. This lanyard 5 is fastened at its top end to the topmost spacer 2 (not shown in the drawing), while its bottom end is connected with a delivery device (also not shown in the drawing). By the driving motion of this delivery device, the lanyard 5 is drawn out along the longitudinal direction of the longerons 1.

The joint 4 to connect each leg 26 of the spacer 2 and the longeron 1 is constructed, as shown in FIG. 6, with a crown 41 capped onto the tip end of the leg 26 of the spacer 2, a neck portion 42 protruded from the crown part 41 in the direction of projection of the leg 26, and a frame portion 43 connected with the neck portion 42 and fixed to the longeron 1 in a manner to surround the same.

Further, the joint 4 and the leg 26 of the spacer 2 are made relatively rotatable in two directions through the neck portion 42 with a line C—C′ in FIG. 6 as the principal rotational axis, and through the crown part 41 with a line D—D′ as the auxiliary rotational axis, although this latter rotation along the above-mentioned auxiliary rotational axis D—D′ is not always necessary.

By the way, a small gap $G_1$ is provided betwen the tip end part of the neck portion 42 and one end face of the longeron 1 to the side of the spacer 2. This gap $G_1$ is further made equal to, or somewhat longer than, a gap $G_2$ between the end face of the crown portion 41 and the end face of the joint 4.

In the following, explanations will be made as to a state wherein this extendible structure has been collapsed in a loop form, and a state wherein it is on the way of extension.

Figure 7:
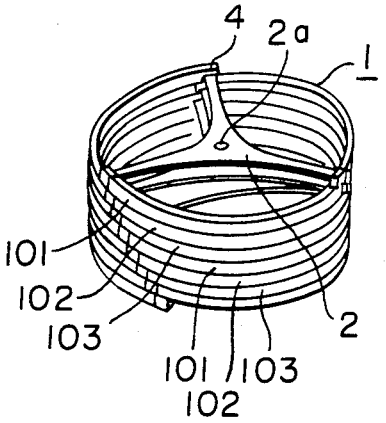
FIG. 7 is a perspective view of the preferred embodiment of the extendible structure according to the present invention shown in FIG. 4 when it is collapsed.

In its collapsed state, the three longerons 1 are superimposed one another in a smoothly coiled form as shown in FIG. 7, and its external appearance as a whole is in a cylindrical form. In this superimposed state, each of the longerons 101, 102 and 103 is mutually adjacent in a certain definite sequence such that the longeron 102 is beneath the longeron 101, the longeron 103 is underneath the longeron 102, and the longeron 101 is underneath the longeron 103. Each spacer 2 having radially projecting legs is positioned inside the loop formed by the longerons 1, as is apparent from FIG. 7, and the through-holes 2*a* in these spacers 2 are aligned on one line as viewed from the vertical direction. The spacers 2 which are laid one on another are slightly and sequentially offset in the circumferential direction of the coiled longerons 1 with the through-holes *2a* therein as the center.

In the collapsed state of the extendible structure as explained above, when the bridle 5 is drawn out upwardly by the delivery device (not shown in the drawing) with the bottom end part of the coil-shaped longerons 1 being held firmly, the spacers 2 rotate with the bridle 5 as the center of rotation following this drawing operation, while the longerons 1 collapsed in the coil shape are being extended in such a fashion that the loop may be dissolved, as shown in FIG. 8, and, after completion of the draw-out operation, it assumes the upright condition as shown in FIG. 4.

Incidentally, when collapsing this structure which is in the perfectly extended state, the reverse to the above-described steps are performed, whereby the structure is collapsed in the loop form to return to the condition as shown in FIG. 7.

In the following, another embodiment of the extendible structure according to the present invention will be explained in reference to FIG. 9. This embodiment is made up of two units of the extendible structure shown in FIGS. 4 through 8 combined into a single unitary form. That is to say, this extendible structure is constructed with two units of the extendible structure 10 and 20 which are disposed in series and a delivery section 6 interposed at the center of these two units 10 and 20. Each of the units 10 and 20 is constructed in the same way as that of the afore-described embodiment. That is, the spacers 12 and 22 having the radially projecting legs are connected with three longerons 11 and 21 through the joints 14 and 24, for each unit, the bridles 13 and 23 are extended between the adjacent joints 14 and 24 which are at the diagonally opposed positions, and the lanyards 15 and 25 pass through the center part of the spacers 12 and 22.

The highly characteristic points of this embodimental structure here are that: first, this pair of units 10 and 20 are mutually connected at their one end part with the central delivery section 6, either directly or indirectly; secondly, the direction of the coil formation in each unit is symmetrical to form a mirror image on the march of the central delivery section; and thirdly, the drawout of the upper and lower lanyards 15 and 25 is synchronized.

In this extendible structure, when the lanyards 15 and 25 are drawn out to both upper and lower directions from its collapsed state, these upper and lower units 10 and 20 extend to an equal length. In this case, the direction of separation of the coil-shaped longerons 1 in the respective upper and lower units 10 and 20 is mutually symmetrical to form a mirror image as viewed at the central delivery section 6, and both outer end parts of the upper and lower units 10 and 20 rotate in the same direction at a substantially equal speed. As the consequence of this, both units do not rotate relatively. Inversely, even when both outermost end parts of these units are restrained so as not to rotate around the axis, the units continue their extension, and the central delivery section 6 rotates instead. Upon completion of the extension, there will be formed a rigidly continued mast-shaped structure without any rotationally sliding part in its main structure.

A similar example for assisting understanding of the above-mentioned phenomenon may be realized by extending a rubber band between the thumb and the pointing finger, and then putting a match stick at an intermediate position of the extended rubber band, followed by twisting the band in one direction. In this instance, the direction of the loop formation is symmetrical in a mirror image, the both ends do not rotate as a matter of course, with the center part alone being rotated, and no sliding part exists at any portion of the loop. In other words, the formation and the dissolution of a pair of mirror-imaged loops offset the relative rotation at both ends of the loops.

There has also been known a so-called canister device which purports to contribute to maintenance of the rigidity in the rectilinear longerons, wherein, at the time of extension of the units of the extendible structure, the sliding rotation of the end parts and the transitary movement from the coiled form to the rectilinear extension are effected in the canister device without performing any apparent rotation. In the embodiment of FIG. 9, if a structure of two canister devices joined together back to back is adopted as the central delivery section 6 and then the main structural members of the two units 10 and 20 are mutually connected through the canister devices, there can be obtained the extendible structure which maintains sufficient rigidity even during its extension.

Figure 9:
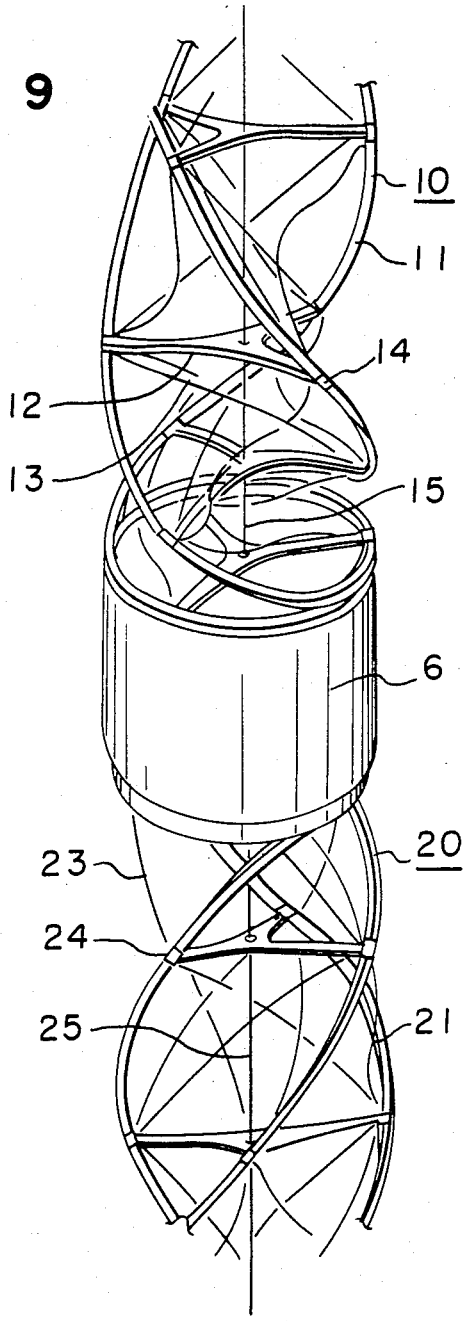
FIG. 9 is a further perspective view of another embodiment of the extendible structure accoridng ot the present invention showing a state of the structure being extended.
Figure 10:
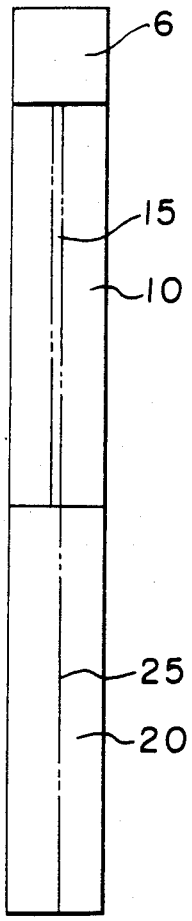
FIG. 10 is a schematic diagram showing still another embodiment of the extendible structure according to the present invention.
Figure 11:
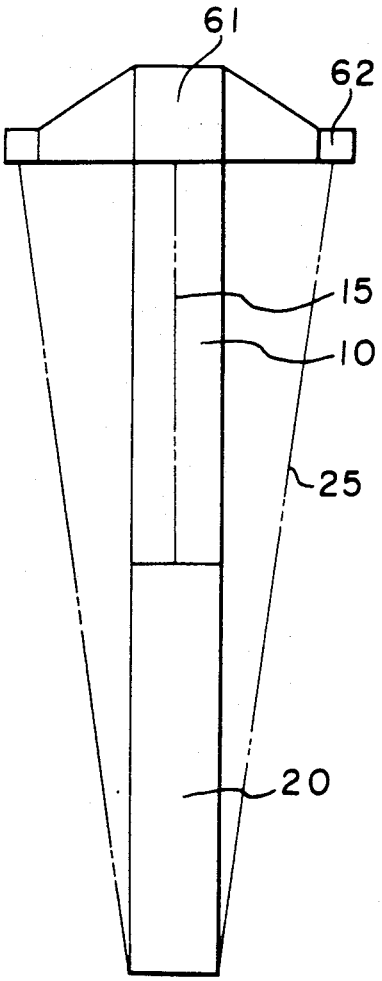
FIG. 11 is also a schematic diagram showing other embodiment of the extendible structure according to the present invention.

Since the fundamental concept of the embodiment shown in FIG. 9 resides in restraining the rotation at the end parts of the loop by the serial connection of a plurality of units forming the loops in the mutually opposite directions, there may be further contemplated those embodiments as shown in FIGS. 10 and 11.

The embodiment of FIG. 10 is such that the units 10 and 20 are provided on one side of the delivery section 6, wherein the length of extension of both units 10 and 20 are kept equal. The lanyard 25 for the unit 20 is connected with the delivery section 6 through the unit 10, and, when the delivery speed of the lanyard 25 is made, for example, twice as fast as that of the lanyard 15, the unit 20 extends by an equal length as that of the unit 10, and performs an equal angular rotation without the relative rotation at both end parts.

In the embodiment shown in FIG. 11, the unit 10 and the unit 20 are so constructed that their extension and collapse may be done by separate delivery sections 61 and 62, wherein the lanyard 15 of the unit 10 is drawn out in the dirction parallel to the direction of extension of the unit 10, while the lanyard 25 of the unit 20 is drawn out slantly with respect to the direction of extension of the unit 20 so as to intersect mutually. In more detail, the lanyard 25 of the unit 20 is extended outside the units 10 and 20, and controlled by the delivery section 62 so that, upon completion of the extension, it may contribute to rigidity of the unit as a tension-imparting member.

In should be noted incidentally that the two units may not always be synchronized accurately in their rotation, even if their extension is brought into synchronism. However, when restriction is imparted to the rotation at both end parts, the two units are accurately synchronized in their rotation. In this embodiment, when the lanyards 25 are disposed in a three-dimensional manner, the rotation at both end parts is restrained and, in addition, a stable construction of the extendible structure is secured after it has been extended.

A mention is made here as to the longerons 1, 11 and 21 in the above-described embodiments. When collapsing these longerons 1, 11 and 21 in the loop form, there may be used any of the well known methods for regulating the loop forming direction, such as one wherein a stopper is provided on the joints 4, 14 and 24 between the longerons 1, 11 and 21 and the spacers 2, 12, and 22; the one wherein the cross-sectional shape of the longerons 1, 11 and 21 is varied in part, the one wherein the initial twisting force is imparted to the longerons 1, 11, and 21, and various others.

By the way, in the foregoing explanations, an example of a case has been given, wherein each of the longerons 1, 11, and 21 is made of a single, elastic, and continuous material. However, each of such longerons 1, 11, and 21 may be made up of a material having numerous joints, i.e., the longeron is constructed with numerous pieces of longeron and a plurality of rotatory joints to sequentially connect these longeron pieces, as disclosed, for example, in U.S. Pat. No. 3,486,279.

Furthermore, a construction which becomes tapered in the longitudinal direction in its extended state, or a construction with the cross-section of the structure being varied along the longitudinal direction may also be effective under particular conditions. Also, a structure of a design, wherein the longeron is sectioned at a certain definite length in the longitudinal direction and a plurality of such sectioned longerons, each being as one section, are connection together, may be particularly effective from the point of productivity.

Figure 12:
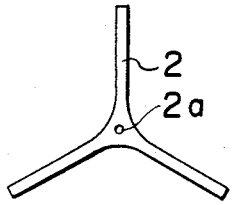
FIG. 12 is a top plan view showing another embodiment of the spacer for use in the extendible structure according to the present invention.
Figure 13:
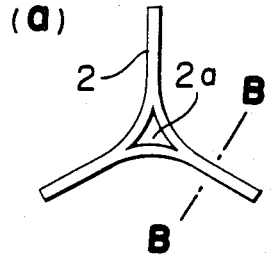
FIG. 13A is a top plan view showing still another embodiment of the spacer.
FIG. 13B is a cross-sectional view taken along a line B—B in FIG. 13A, when a plurality of the spacers are laid one after the other in a snugly fitted manner.
Figure 14:
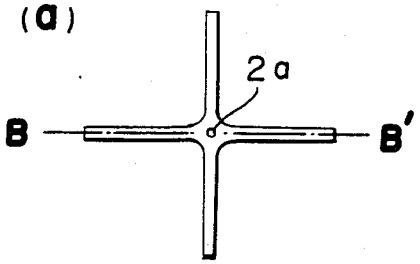
FIG. 14A is a top plan view showing other embodiment of the spacer.
FIG. 14B is a longitudinal cross-sectional view taken along a line B—B in FIG. 14A of the spacer.

There are various modifications for the integrated radial spacers 2, 12, and 22 having radially projecting legs formed integrally with the center part as shown, for example, in FIGS. 12 to 14.

In the example of FIG. 12, the spacer 2 has an area at the center part thereof, which is smaller than that shown in FIG. 5.

The example of FIG. 13 has a triangular shape of the through-hole *2a* at the center part thereof, and has the side edges of the legs 2 are bent downward obliquely as shown in FIG. 13B, thus forming a groove in the leg as a whole. According to this construction, reduction in weight and increase in mechanical strength of the spacer 2 can be realized, whereby, when the extendible structure of the present invention is collapsed, the spacers 2, each having the groove-shaped legs, can be superimposed snugly one another.

In the example of FIG. 14, four legs *2b* project radially from the center part of the spacer, and the cross-sectional shape of the legs *2b* is smoothly bent downwardly as it goes outwardly from its center part, as shown in FIG. 14B, in consideration of reduction in weight and appropriate distribution of rigidity of the spacer.

Figure 15:
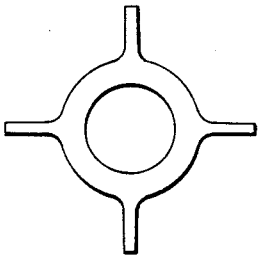
FIG. 15 is a top plan view showing still other embodiment of the spacer for use in the extendible structure according to the present invention.
Figure 13:
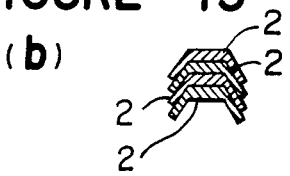
Figure 14:
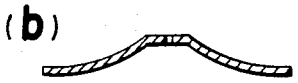

The example of FIG. 15 provides four legs *2b* to project from an annular center part, wherein the diameter of the through-hole *2a* is approximate to the length of the leg *2b*.

According to the network theory in the mechanics, the shortest distance to connect three equi-distant points in space is not a triangle connecting the three points, but the distance to connect the three points and the center of the triangle. Accordingly, the radial spacer according to the present invention has the shortest path to connect the component members in comparison with the spacer of the conventional extendible structure shown in FIGS. 1 through 3, which is constructed with thin square bars in a triangular form.

From the standpoint of dynamics, too, these two cases are different to a considerable extent. That is to say, the triangle constructed with the thin square bars is apparently a triangular truss, while the integrated radial spacer of the present invention has the Rahmen structure which bears the bending moment within the plane at the center part thereof.

Thus, according to the present invention, much simpler construction of the spacer becomes possible in comparison with what has so far been considered simple in construction. In more detail, the conventional construction is made up of a combination of three planar trusses in a ladder form, which are a complete structure by itself. However, the construction according to the present invention has no planar truss including the spacers, so that it is not possible to disintegrate the structure into a plurality of planar trusses. In this sense, the construction according to the present invention has no structural redundancy.

In the foregoing, the present invention has been described specifically with reference to preferred embodiments thereof. It should, however, be noted that these embodiments are merely illustrative and not so restrictive, and that any changes and modifications may be made by those skilled in the art within the ambit of the present invention as recited in the appended claims.

I claim:

1. An extendible structure, comprising in combination:

(a) three or more numbers of extendible longerons;

(b) a plurality of joints provided on each of said longerons at predetermined space intervals along them;

(c) a plurality of integrated radial spacers, each having a plurality of legs integrally formed with said spacer and radially extending from the center part thereof, each leg being rotatably connected with said joint provided at differing position on each of said longerons; and (d) a plurality of bridles for connecting one of said joints with adjacent another joint at a diagonally opposed position, in the extended condition of said extendible structure, said three or more longerons being deployed in parallel one another with space intervals among them in the lateral direction which intersects with the direction of extension of said longerons, said spacers supporting said longerons with the horizontally spaced interval within a plane substantially perpendicular to the direction of extension of said longerons, and said bridles being extended to impart the tensile force between the joints which are at the diagonally opposed positions, and in the collapsed condition of said extendible structure, each of said longerons being collapsed in a loop form, and said spacers being laid one upon another inside said loop formed by said longerons.

2. The extendible structure according to claim 1, characterized in that each of said longerons is made of a flexible member which is elastically continuous.

3. The extendible structure according to claim 1, characterized in that the legs of said spacer are connected with said joints in a freely rotatable manner with the direction of their projection as the axis of rotation.

4. The extendible structure according to claim 1, characterized in that said longerons are collapsed in a coil form, and extended spirally from said collapsed state.

5. The extendible structure according to claim 1, characterized in that each of said longerons is made up of a plurality of longeron pieces and a plurality of rotational joints to sequentially connect said longeron pieces.

6. An extendible structure which comprises in combination:

(a) a first unit of the extendible structure;

(b) a second unit of the extendible structure; and (c) a connecting section to serially connect said first and second units of the extendible structure, said first and second units of the extendible structure being so constructed that they may be extended and collapsed symmetrically in a mirror image on the march of said connecting section, and each of said extendible structure units comprising three or more numbers of extendible longerons; a plurality of joints provided on each of said longerons at predetermined space intervals among them; a plurality of integrated radial spacers, each having a plurality of legs integrally formed with said spacer and radially extending from the center part thereof, each leg being rotatably connected with said joint provided at differing position on each of said longerons; and a plurality of bridles for connecting one of said joints with adjacent another joint at a diagonally opposed position, wherein, in the extended condition of said extendible structure, said three or more longerons are deployed in parallel one another with space intervals among them in the lateral direction which intersects with the direction of extension of said longerons, said spacers support said longerons with the horizontally spaced interval within a plane substantially perpendicular to the direction of extension of said longerons, and said bridles are extended to impart the tensile force between the joints which are at the diagonally opposed positions, while, in the collapsed condition in a loop form, and said spacers are laid one upon another inside said loop formed by said longerons.

7. The extendible structure according to claim 6, characterized in that there is further provided a delivery device for composite control of the extending speed of said first and second units of the extendible structure.

8. The extendible structure according to claim 7, characterized in that said delivery device is provided between said first and second units of the extendible structure.

9. The extendible structure according to claim 7, characterized in that said first and second units of the extendible structure are provided on one and same side as viewed from said delivery device.

* * * * *